US009767946B2

(12) United States Patent
Zaizen et al.

(10) Patent No.: US 9,767,946 B2
(45) Date of Patent: Sep. 19, 2017

(54) NON-ORIENTED ELECTRICAL STEEL SHEET BEING LESS IN DETERIORATION OF IRON LOSS PROPERTY BY PUNCHING

(71) Applicant: JFE STEEL CORPORATION, Tokyo (JP)

(72) Inventors: Yoshiaki Zaizen, Kurashiki (JP); Yoshihiko Oda, Fukuyama (JP); Hiroaki Toda, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 327 days.

(21) Appl. No.: 14/418,351

(22) PCT Filed: Aug. 1, 2013

(86) PCT No.: PCT/JP2013/070836
§ 371 (c)(1),
(2) Date: Jan. 29, 2015

(87) PCT Pub. No.: WO2014/030512
PCT Pub. Date: Feb. 27, 2014

(65) Prior Publication Data

US 2015/0187475 A1 Jul. 2, 2015

(30) Foreign Application Priority Data

Aug. 21, 2012 (JP) ..... 2012-182322

(51) Int. Cl.
*C21D 8/00* (2006.01)
*H01F 1/147* (2006.01)
(Continued)

(52) U.S. Cl.
CPC ..... *H01F 1/14775* (2013.01); *C22C 38/001* (2013.01); *C22C 38/002* (2013.01);
(Continued)

(58) Field of Classification Search
CPC .. C21D 8/1233; C21D 8/1272; C22C 38/004; H01F 1/14775
(Continued)

(56) References Cited

U.S. PATENT DOCUMENTS 7,922,834 B2 * 4/2011 Tanaka ..... C22C 38/004 148/110
2002/0043299 A1 4/2002 Tanaka et al.
2012/0014828 A1 1/2012 Miyazaki et al.

FOREIGN PATENT DOCUMENTS

CN 102634742 A 8/2012
JP S57-32327 A 2/1982
(Continued)

OTHER PUBLICATIONS

NPL: Machine translation of JP 2001323344A, Nov. 2001.*
(Continued)

*Primary Examiner* — Jie Yang
(74) *Attorney, Agent, or Firm* — Oliff PLC

(57) ABSTRACT

A non-oriented electrical steel sheet has a chemical composition having C: not more than 0.005 mass %, Si: 2-7 mass %, Mn: 0.033 mass %, Al: not more than 3 mass %, P: not more than 0.2 mass %, S: not more than 0.005 mass %, N: not more than 0.005 mass %, Se: 0.0001~0.0005 mass %, As: 0.0005~0.005 mass % and the remainder being Fe and inevitable impurities, and an iron loss $W_{15/50}$ in excitation at 50 Hz and 1.5 T of not more than 3.5 W/kg and a ratio (x/t) of amount of shear drop x (mm) to thickness t (mm) in punching of steel sheet of not more than 0.15 and is excellent in the iron loss property before punching and less in the deterioration of the iron loss property by punching.

2 Claims, 5 Drawing Sheets

(51) Int. Cl.

| | |
|---|---|
| ***C22C 38/60*** | (2006.01) |
| ***H01F 1/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| *C21D 8/12* | (2006.01) |

(52) U.S. Cl.
CPC ..... *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/14791* (2013.01); *H01F 1/16* (2013.01); *C21D 8/1222* (2013.01); *C21D 8/1233* (2013.01); *C21D 8/1261* (2013.01); *C21D 8/1272* (2013.01)

(58) Field of Classification Search
USPC ..... 148/100
See application file for complete search history.

(56) References Cited

FOREIGN PATENT DOCUMENTS

| | | | |
|---|---|---|---|
| JP | S58-53694 | A | 3/1983 |
| JP | H03-36242 | A | 2/1991 |
| JP | H11-71650 | A | 3/1999 |
| JP | H11-131196 | A | 5/1999 |
| JP | 29070436 | B2 | 11/1999 |
| JP | 2000-054085 | A | 2/2000 |
| JP | 2001-059145 | A | 3/2001 |
| JP | 2001-131717 | A | 5/2001 |
| JP | 2001-323344 | A | 11/2001 |
| JP | 2001335897 | A | 12/2001 |
| JP | 2002-030397 | A | 1/2002 |
| JP | 2002-047542 | A | 2/2002 |
| JP | 2003-055746 | A | 2/2003 |
| JP | 2003-243214 | A | 8/2003 |
| JP | 2004-197217 | A | 7/2004 |
| JP | 2005264315 | A | 9/2005 |
| JP | 2007-247047 | A | 9/2007 |
| JP | 2008-050686 | A | 3/2008 |
| JP | 2008-156737 | A | 7/2008 |
| JP | 2008-231504 | A | 10/2008 |
| WO | 2010/140509 | A1 | 12/2010 |
| WO | 2011/155183 | A1 | 12/2011 |

OTHER PUBLICATIONS

Jul. 11, 2016 Office Action issued in Korean Patent Application No. 10-2015-7001046.
Mar. 3, 2016 extended Search Report issued in European Patent Application No. 13830303.7.
Oct. 15, 2013 International Search Report issued in International Application No. PCT/JP2013/070836.
Oct. 27, 2015 Office Action issued in Chinese Patent Application No. 201380025093.7.
Apr. 27, 2016 Office Action issued in Chinese Patent Application No. 201380025093.7.
Jun. 26, 2017 Office Action issued in U.S. Appl. No. 14/767,735.

* cited by examiner

C : 0.0025mass%, Si : 3.0mass%, Al : 0.5mass%, Mn : 0.5mass%, P : 0.01mass%, N : 0.0018mass%, S : 0.0019mass%, Se : 0.0001mass%, As : 0.0010mass%

C: 0.0030mass%, Si: 2.5mass%, Al: 1mass%, Mn: 0.5mass%, P: 0.01mass%, N: 0.0020mass, S: 0.0022mass%, As: 0.001mass%

C : 0.0030mass%, Si : 2.5mass%, Al: 1mass, Mn : 0.5mass%, P : 0.01mass%, N : 0.0020mass%, S : 0.0022mass%, Se : 0.0001mass%

C:0.0020mass%, Si:2.5mass%, Al:0.001mass%, Mn:0.5mass%, P:0.01mass%, N:0.0019mass%, S:0.0024mass%, Se:0.0001mass%, As:0.0008mass%

NON-ORIENTED ELECTRICAL STEEL SHEET BEING LESS IN DETERIORATION OF IRON LOSS PROPERTY BY PUNCHING

TECHNICAL FIELD

This invention relates to a non-oriented electrical steel sheet not only being excellent in the iron loss property before punching but also being less in the deterioration of the iron loss property by punching.

RELATED ART

Recently, it is strongly demanded to enhance an efficiency of electric equipment in line with the global trend of energy saving. As a result, in order to achieve the high-efficiency of the electric equipment, it is a big issue to decrease an iron loss in non-oriented electrical steel sheets widely used as a core material for the electric equipment. In order to respond to the above request for the non-oriented electrical steel sheet, it has hitherto been attempted to decrease the iron loss by adding an element such as Si, Al or the like to enhance specific resistance or by decreasing a thickness of the sheet.

When the non-oriented electrical steel sheet is used as a core material for motors or the like, it is known that the characteristics of the motor or the like are poor as compared to the characteristics of the raw steel sheet. It is considered due to the fact that the characteristics of the non-oriented electrical steel sheet are usually evaluated by Epstein test using a test specimen of 30 mm in width, whereas since the teeth width or yoke width of the actual motor is as narrow as 5~10 mm, the iron loss property is deteriorated due to strain introduced by punching. For example, as a material being less in the deterioration of magnetic properties by such a punching, Patent Document 1 discloses a non-oriented electrical steel sheet wherein shear resistance is made small to decrease amount of strain by adding S in an amount of 0.015~0.035 wt %.

PRIOR ART DOCUMENTS

Patent Documents

Patent Document 1: Japanese Patent No. 2970436

SUMMARY OF THE INVENTION

Task to be Solved by the Invention

However, the steel sheet disclosed in Patent Document 1 contains a great amount of S as compared to the conventional non-oriented electrical steel sheet, so that the magnetic properties of the raw steel sheet itself before punching are poor and hence such a sheet cannot sufficiently meet severer request to the iron loss property in recent years. Therefore, it is strongly desired to develop non-oriented electrical steel sheets being excellent not only in the iron loss property before punching but also in the iron loss property after punching, i.e. being less in the deterioration of the iron loss property by punching.

The invention is made in view of the above problems inherent to the conventional technique and is to provide a non-oriented electrical steel sheet being less in the deterioration of the iron loss property by punching.

Solution for Task

The inventors have focused on an influence of a chemical composition of the steel sheet and a size of shear drop (which is also called as "amount of shear drop" hereinafter) of the steel sheet generated by punching upon the iron loss property and made various studies for solving the above task. Consequently, it has been found out that the size of shear drop of the steel sheet generated by punching is well interrelated to a deterioration ratio of the iron loss property and such a size of shear drop can be diminished without deteriorating the iron loss property of the raw steel sheet by adding adequate amounts of Se and As and hence the deterioration of the iron loss property by punching can be suppressed, and as a result, the invention has been accomplished.

The invention is based on the above knowledge and lies in a non-oriented electrical steel sheet characterized by having a chemical composition comprising C: not more than 0.005 mass %, Si: 2~7 mass %, Mn: 0.03~3 mass %, Al: not more than 3 mass %, P: not more than 0.2 mass %, S: not more than 0.005 mass %, N: not more than 0.005 mass %, Sc: 0.0001~0.0005 mass %, As: 0.0005~0.005 mass % and the remainder being Fe and inevitable impurities, and an iron loss $W_{15/50}$ in excitation at 50 Hz and 1.5 T of not more than 3.5 W/kg and a ratio (x/t) of amount of shear drop x (mm) to thickness t (nm) in punching of steel sheet of not more than 0.15.

The non-oriented electrical steel sheet of the invention is characterized in that an average crystal grain size is 30~150 μm.

Also, the non-oriented electrical steel sheet of the invention is characterized by containing either one or both of Sn: 0.003~0.5 mass % and Sb: 0.003~0.5 mass % in addition to the above chemical composition.

Effect of the Invention

According to the invention can be stably provided, a non-oriented electrical steel sheet being excellent not only in the iron loss property before punching but also in the iron loss property after punching, i.e. being less in the deterioration of the iron loss property by punching, so that it can largely contribute to enhance the efficiency of the electric equipment such as motors or the like using a core produced by punching.

EMBODIMENTS FOR CARRYING OUT THE INVENTION

Experiments providing an opportunity to develop the invention will be described below.

<Experiment 1>

In order to research an influence of a size of shear drop generated by punching (amount of shear drop) upon iron loss property, a steel slab containing C: 0.0025 mass %, Si: 3.0 mass %, Al: 0.5 mass %, Mn: 0.5 mass %, P: 0.01 mass %, N: 0.0018 mass %, S: 0.0019 mass %, Se: 0.0001 mass % and As: 0.0010 mass % is heated at 1100° C. for 30 minutes and hot rolled to form a hot rolled sheet of 2.0 mm in thickness, and the hot rolled sheet is subjected to a hot band annealing at 980° C. for 30 seconds and cold rolled at once to form cold rolled sheets having various thicknesses of 0.20~0.50 mm, and thereafter these sheets are subjected to a finish annealing at 950° C. for 10 seconds and coated with an insulating coating to obtain non-oriented electrical steel sheets (product sheets). Moreover, the average crystal grain size at a section of the product sheet in the rolling direction (L-direction) is about 80 μm as measured by linear intercept method.

Figure 1:
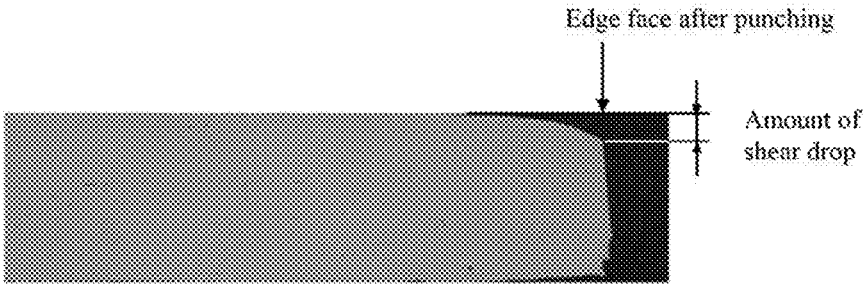
FIG. 1 is a view defining an amount of shear drop by punching.

Then, a test specimen with a length of 180 mm and a width of 30 mm and a test specimen with a length of 180 mm and a width of 10 mm are taken out from the product sheet in L-direction and C-direction by punching set to a clearance of 5%. The clearance means a value (%) obtained by dividing a gap between punch and die by a thickness of the sheet to be worked. Also, a size of shear drop (amount of shear drop) is measured at an edge face of the test specimen punched at a width of 10 mm. Here, the amount of shear drop is defined as shown in FIG. 1.

Figure 2:
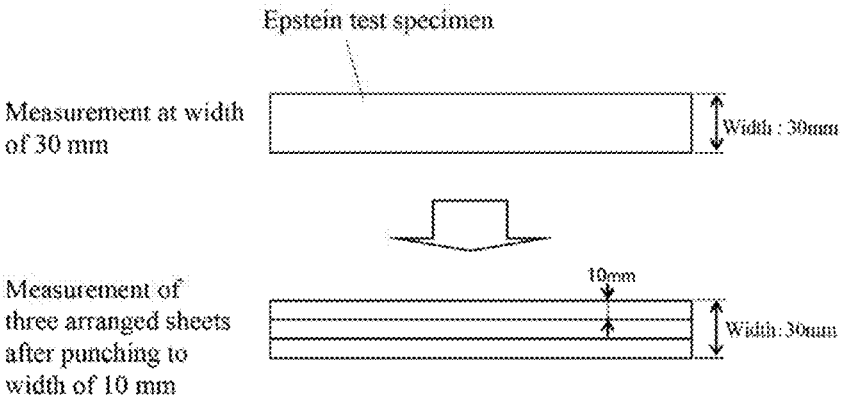
FIG. 2 is a view illustrating a method of measuring iron loss with a test specimen of 30 mm in width and a test specimen of 10 mm in width by Epstein test.

With the above test specimens, iron loss $W_{15/50}$ is measured by Epstein test. In this case, the measurement of the test specimen with a width of 10 mm is performed by arranging three test specimens in widthwise direction so as to provide a width of 30 mm as shown in FIG. 2. In such a measurement of the iron loss, two shear portions are included in the test specimens arranged at a width of 30 mm, so that the influence of the punching upon the iron loss property can be evaluated. Moreover, the influence of the punching upon the iron loss property is evaluated by a deterioration ratio of iron loss $W_{15/50}$ of test specimen with a width of 10 mm to iron loss $W_{15/50}$ of test specimen with a width of 30 mm (iron loss deterioration ratio) as defined in the following equation:

$$\text{Iron loss deterioration ratio (\%)}=\{(W_{15/50}(10\text{ mm width}))-(W_{15/50}(30\text{ mm width}))\}/(W_{15/50}(30\text{ mm width}))\times 100$$

Figure 3:
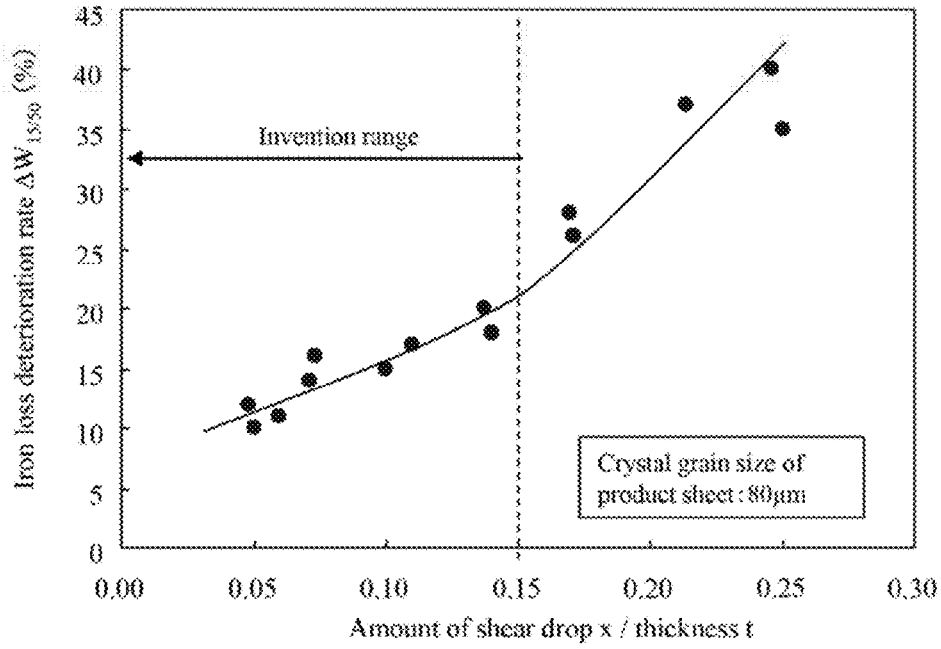
FIG. 3 is a graph showing an influence of a ratio of amount of shear drop x to thickness t (x/t) upon iron loss deterioration ratio.

The measured results are shown in FIG. 3 as a relation between the ratio of amount of shear drop x to thickness t (x/t) in punching and the iron loss deterioration ratio. As seen from this figure, the iron loss deterioration ratio can be reduced to not more than 20% when the ratio of amount of shear drop x to thickness t (x/t) is made to not more than 0.15. This is considered due to the fact that as the ratio of amount of shear drop to thickness (x/t) becomes large, compression stress is retained in the vicinity of the edge face produced by punching to deteriorate the magnetic properties. From this result, the ratio of amount of shear drop x to thickness t (x/t) is set to not more than 0.15 in the invention.

<Experiment 2>

Next, the inventors have made the following experiment by taking notice of Se and As, which are grain boundary segregation type elements for weakening grain boundary strength, as a measure reducing the amount of shear drop at the edge face produced by punching.

A steel slab containing C: 0.0030 mass %, Si: 2.5 mass %, Al: 1 mass %, Mn: 0.5 mass %, P: 0.01 mass %, N: 0.0020 mass %, S: 0.0022 mass %, Se: 0.0001~0.002 mass % and As: 0.0001~0.010 mass % is heated at 1100° C. for 30 minutes and hot rolled to form a hot rolled sheet of 2.0 mm in thickness, and the hot rolled sheet is subjected to a hot hand annealing at 980° C. for 30 seconds and cold rolled at once to form a cold rolled sheet of 0.50 min in thickness, and thereafter the cold rolled sheet is subjected to a finish annealing at 970° C. for 10 seconds and coated with an insulating coating to obtain a non-oriented electrical steel sheet (product sheet).

Test specimens with a length of 180 mm and a width of 10 mm are taken out from the thus obtained product sheet in L-direction and C-direction by punching set to a clearance of 5%, and then the amount of shear drop at edge face after punching is measured as Experiment 1 and the iron loss $W_{15/50}$ is measured by Epstein test. Moreover, the iron loss of the test specimen with the width of 10 mm is measured by arranging three test specimens in the widthwise direction so as to provide a width of 30 mm.

Figure 4:
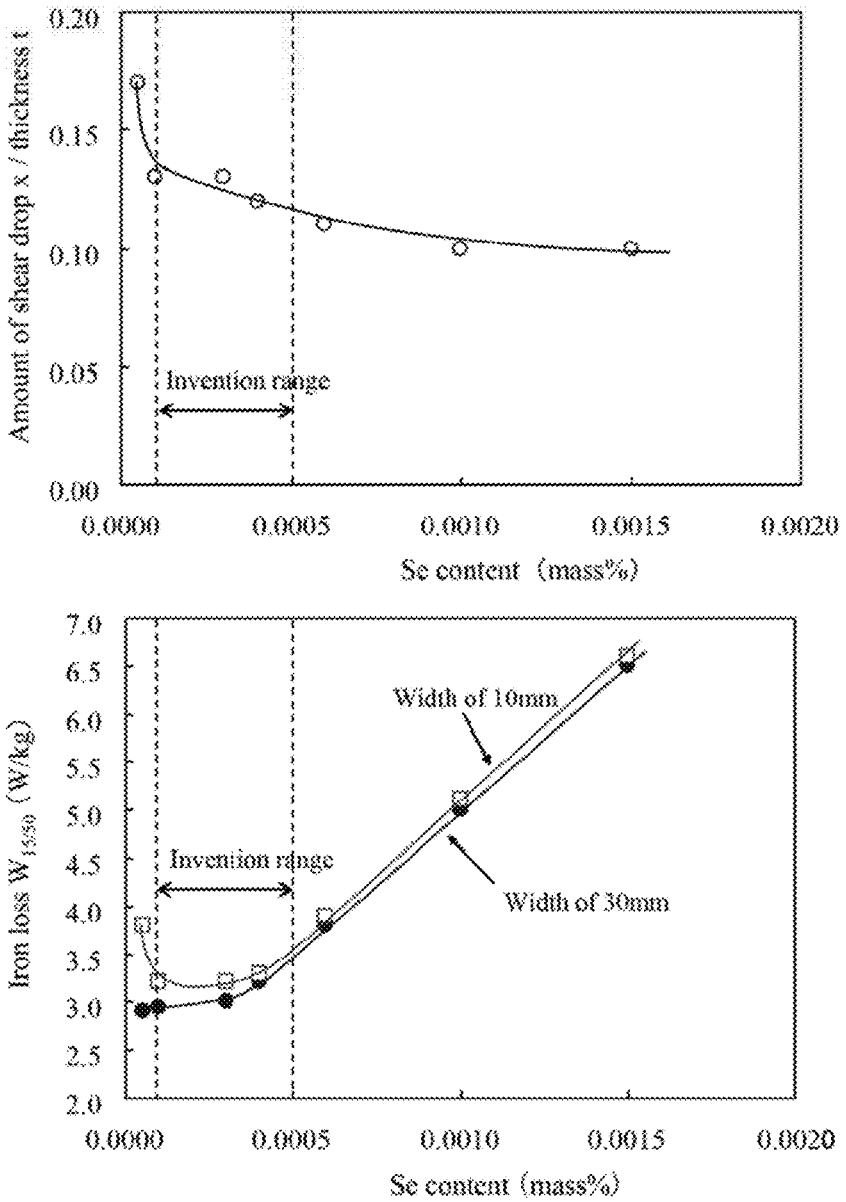
FIG. 4 is a graph showing an influence of Se content upon a ratio of amount of shear drop x to thickness t (x/t) and iron loss $W_{15/50}$.
Figure 5:
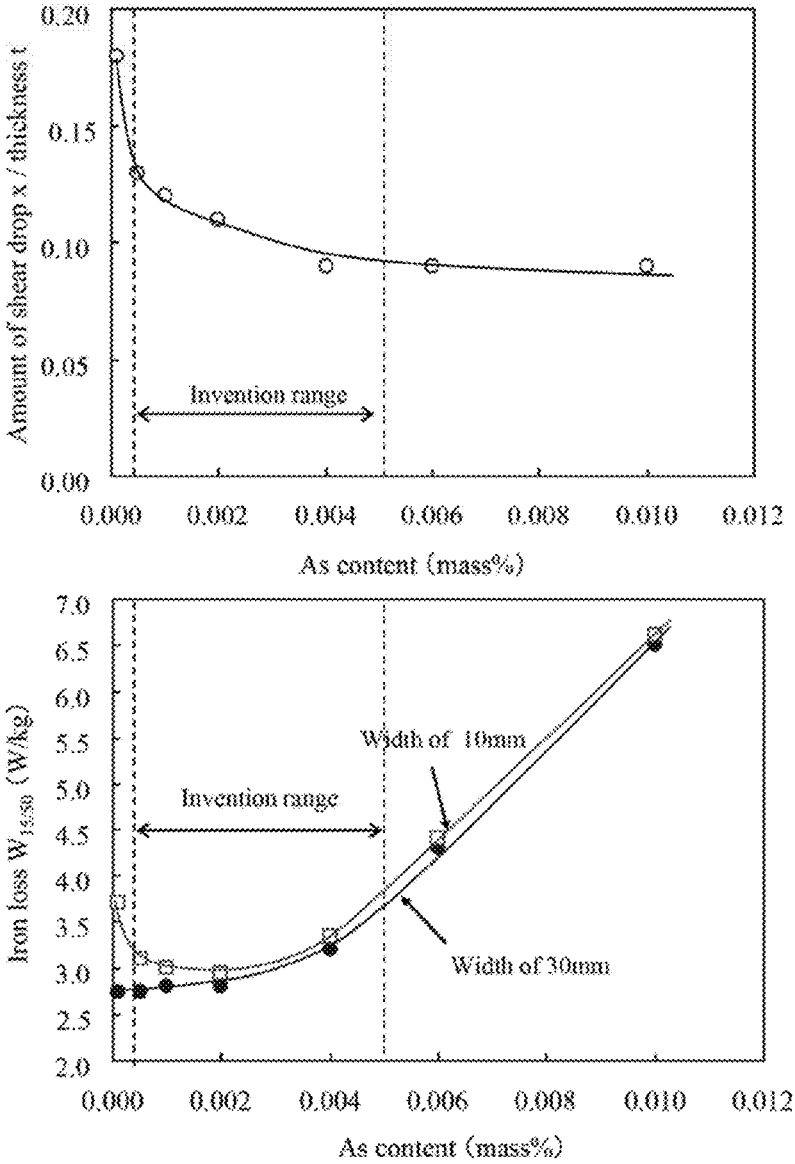
FIG. 5 is a graph showing an influence of As content upon a ratio of amount of shear drop x to thickness t (x/t) and iron loss $W_{15/50}$.

FIG. 4 shows an influence of Se content upon the ratio of amount of shear drop x to thickness t (x/t) and the iron loss $W_{15/50}$, and FIG. 5 shows an influence of As content upon the ratio of amount of shear drop x to thickness t (x/t) and the iron loss $W_{15/150}$, As seen from these figures, the size of shear drop can be made small by setting Se≥0.0001 mass % and As≥0.0005 mass %. This is considered due to the fact that since Se and As are grain boundary segregation type elements and have an effect of weakening the grain boundary strength, shear resistance is made small in punching to diminish the shear drop. On the other hand, it can be seen that the iron loss property is largely deteriorated at Se>0.0005 mass % and As>0.005 mass %. This is considered due to the fact that when great amounts of Sc and As are included, a great amount of precipitates is formed to increase hysteresis loss.

From these results, Se of 0.0001~0.0005 mass % and As of 0.0005~0.005 mass % are added in the invention.

<Experiment 3>

Further, the inventors have made an experiment for investigating an influence of a crystal grain size upon the amount of shear drop.

A steel slab containing C: 0.0020 mass %, Si: 2.5 mass %, Al: 0.001 mass %, Mn: 0.5 mass %, P: 0.01 mass %, N: 0.0019 mass %, S: 0.0024 mass %, Se: 0.0001 mass % and As: 0.0008 mass % is heated at 1100° C. for 30 minutes and hot rolled to form a hot rolled sheet of 2.0 mm in thickness, and the hot rolled sheet is subjected to a hot band annealing at 1000° C. for 30 seconds and cold rolled at once to form a cold rolled sheet of 0.35 mm in thickness, and thereafter the cold rolled sheet is subjected to a finish annealing by keeping various temperature of 750~1100° C. for 10 seconds to obtain non-oriented electrical steel sheets (product sheets) having different crystal grain sizes.

A test specimen with a length of 180 mm and a width of 30 mm and a test specimen with a length of 180 mm and a width of 10 mm are taken out from the thus obtained product sheet in L-direction and C-direction by punching set to a clearance of 5%, and then the amount of shear drop at edge face after punching is measured as Experiment 1 and the iron loss $W_{15/50}$ is measured by Epstein test and the average crystal grain size of the product sheet at a section in the rolling direction (L-direction) is measured by linear intercept method. Moreover, the iron loss of the test specimen with the width of 10 mm is measured by arranging three test specimens in the widthwise direction so as to provide a width of 30 mm.

Figure 6:
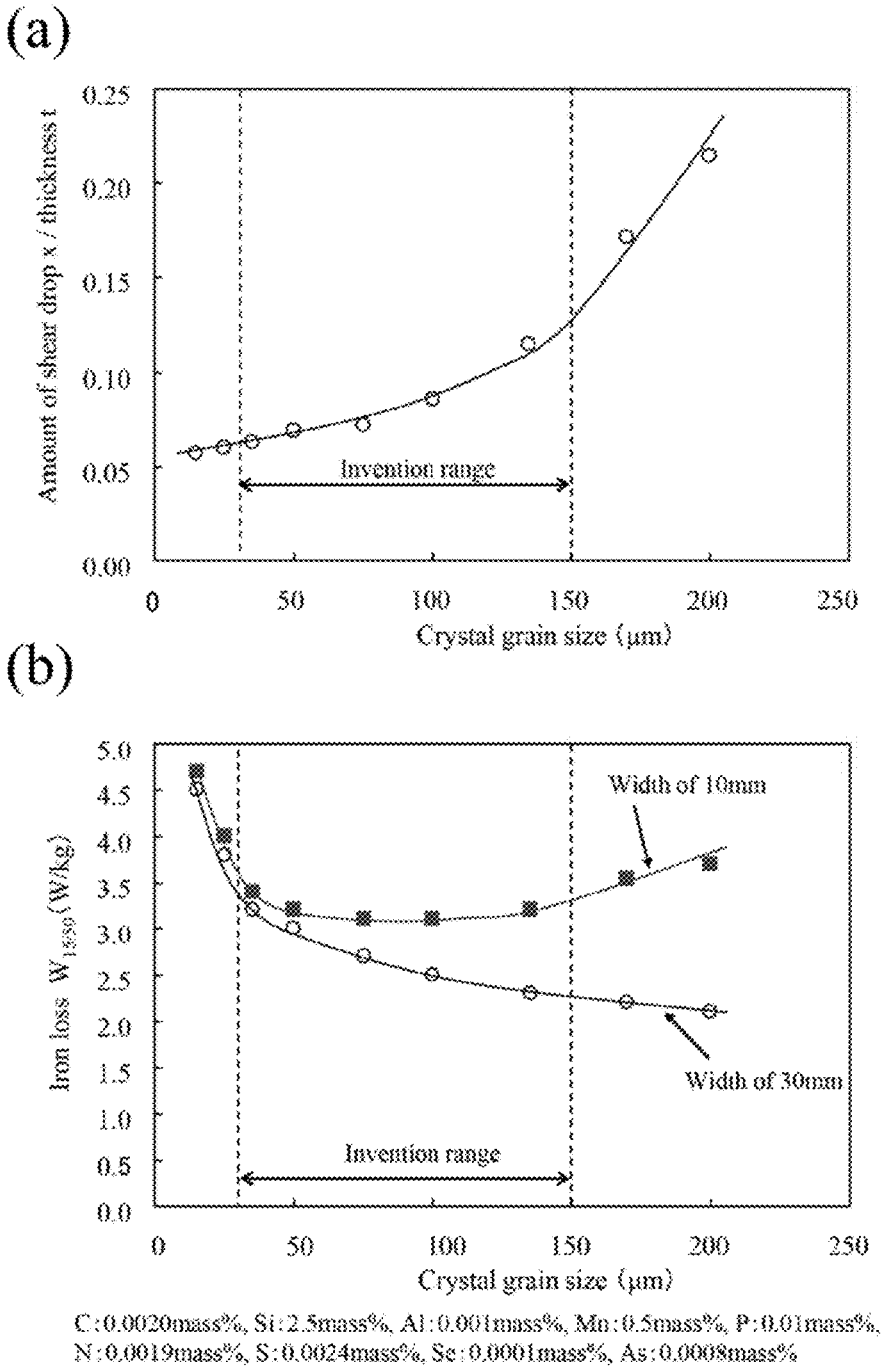
FIG. 6 is a graph showing an influence of average crystal grain size upon a ratio of amount of shear drop x to thickness t (x/t) and iron loss $W_{15/50}$.

FIG. 6(*a*) shows an influence of the crystal grain size upon the ratio of amount of shear drop x to thickness t (x/t). As seen from this figure, the amount of shear drop in punching can be decreased by setting the average crystal grain size to not more than 150 μm. This is considered due to the fact that as the crystal grain size becomes smaller, the abundance of grain boundary becomes higher and the shear resistance in punching becomes smaller. Also, FIG. 6(*b*) shows an influence of the crystal grain size upon the iron loss $W_{15/50}$. As seen from this figure, the iron loss $W_{15/50}$ is deteriorated when the average crystal grain size is not more than 30 μm. This is considered due to the fact that as the crystal grain size becomes smaller, hysteresis loss becomes large.

It can be seen from the above that the average crystal grain size of the non-oriented electrical steel sheet according to the invention is preferable to be a range of 30~150 μm.

The chemical composition of the non-oriented electrical steel sheet (product sheet) according to the invention will be described below.

C: not more than 0.005 mass %

When C content exceeds 0.005 mass %, there is a fear of causing the magnetic aging to deteriorate the iron loss. Therefore, C content is not more than 0.005 mass %.

Si: 2~7 mass %

Si is an element effective for enhancing specific resistance of steel to reduce the iron loss. When it is less than 2 mass %, the above effect is small. While when it exceeds 7 mass %, steel is hardened and it is difficult to be produced by rolling. Therefore, Si content is in a range of 2~7 mass %.

Mn: 0.03~3 mass %

Mn is an element required for improving hot workability. When it is less than 0.03 mass %, the above effect is not sufficient, while when it exceeds 3 mass %, the increase of raw material cost is caused. Therefore, Mn content is in a range of 0.03~3 mass %.

Al: not more than 3 mass %

Al is an element effective for enhancing specific resistance of steel to reduce the iron loss as Si. However, when it exceeds 3 mass %, steel is hardened and it is difficult to be produced by rolling. Therefore. Al content is not more than 3 mass %.

P: not more than 0.2 mass %

In the invention, P is added for enhancing specific resistance of steel to reduce the iron loss, but when it exceeds 0.2 mass %, embrittlement of steel becomes violent and breakage is caused in the cold rolling. Therefore, P content is restricted to not more than 0.2 mass %.

S: not more than 0.005 mass %, N: not more than 0.005 mass %

S and N are inevitable impurity elements. When each of them is added exceeding 0.005 mass %, the magnetic properties are deteriorated. Therefore, S and N are restricted to not more than 0.005 mass %, respectively.

Se: 0.0001~0.0005 mass %, As: 0.0005~0.005 mass %

Se and As are grain boundary segregation type elements as previously mentioned, and have an effect of weakening grain boundary strength to suppress the generation of shear drop in punching. The above effect is obtained by adding Se: not less than 0.0001 mass % and As: not less than 0.0005 mass %. While, when Se: more than 0.0005 mass % and As: more than 0.005 mass % are added, a great amount of precipitates is formed to increase hysteresis loss and deteriorate the iron loss property. Therefore, Se and As contents are Se: 0.0001~0.0005 mass % and As: 0.0005~0.005 mass %.

In the non-oriented electrical steel sheet of the invention, the remainder other than the above ingredients is Fe and inevitable impurities. However, either one or both of Sn: 0.003~0.5 mass % and Sb: 0.003~0.5 mass % may be added for the purpose of improving the iron loss property.

Sn and Sb are elements having such an effect that oxidation or nitriding of a surface layer of the steel sheet as well as formation of fine particles in the surface layer associated therewith are suppressed to prevent deterioration of the magnetic properties. In order to develop such an effect, each of them is preferable to be contained in an amount of not less than 0.003 mass %. While when it exceeds 0.5 mass %, the growth of crystal grains is obstructed and hence there is a fear of deteriorating the magnetic properties. Therefore, each of Sn and Sb is preferable to be added within a range of 0.003~0.5 mass %.

There will be described the production method of the non-oriented electrical steel sheet according to the invention below.

The production method of the non-oriented electrical steel sheet according to the invention is preferable to comprise a series of steps of melting a steel having the aforementioned chemical composition adapted to the invention according to the usual refining process with a converter, an electric furnace, a vacuum degassing apparatus or the like, shaping into a steel slab by a continuous casting method or an ingot making-slabbing method, hot rolling the steel slab, subjecting to a hot band annealing if necessary, cold rolling, finish annealing and forming an insulation coating.

In the above production method, conditions before the hot band annealing are not particularly limited, and the process can be performed under the usually known conditions.

Also, the cold rolling may be a single cold rolling or two or more cold rollings with an intermediate annealing therebetween. Furthermore, the rolling reduction thereof may be same as the production condition in the usual non-oriented electrical steel sheet.

Further, the finish annealing conditions are not particularly limited except that the average crystal grain size is set to in a preferable range of the invention (30~150 μm), and this annealing may be performed according to the annealing conditions in the usual non-oriented electrical steel sheet. Moreover, in order to control the crystal grain size to in the above range, the annealing temperature is preferably in a range of 770~1050° C., more preferably in a range of 800~1020° C.

EXAMPLES

A steel slab having a chemical composition shown in Table 1 is reheated at 1100° C. for 30 minutes and hot rolled to form a hot rolled sheet of 2.0 mm in thickness, and the hot rolled sheet is subjected to a hot band annealing at 1000° C. for 30 seconds and cold rolled at once to form a cold rolled sheet having a thickness shown in Table 2, and thereafter the cold roiled sheet is subjected to a finish annealing by keeping at a temperature also shown in Table 2 for 10 seconds to obtain a non-oriented electrical steel sheet (product sheet).

TABLE 1

| No. | Chemical Composition (mass %) | | | | | | | | | | | Remarks |
|---|---|---|---|---|---|---|---|---|---|---|---|---|
| | C | Si | Mn | Al | S | N | Se | As | P | Sn | Sb | |
| 1 | 0.0030 | 3.0 | 0.50 | 0.50 | 0.0018 | 0.0026 | 0.0001 | 0.0007 | 0.010 | tr. | tr. | Invention Example |
| 2 | 0.0020 | 1.0 | 0.50 | 0.50 | 0.0018 | 0.0026 | 0.0001 | 0.0007 | 0.010 | tr. | tr. | Comparative Example |
| 3 | 0.0030 | 2.5 | 0.50 | 0.001 | 0.0021 | 0.0021 | 0.0001 | 0.0010 | 0.010 | tr. | tr. | Invention Example |
| 4 | 0.0030 | 3.5 | 0.50 | 0.001 | 0.0021 | 0.0021 | 0.0001 | 0.0010 | 0.010 | tr. | tr. | Invention Example |
| 6 | 0.0030 | 4.5 | 0.50 | 0.001 | 0.0021 | 0.0021 | 0.0001 | 0.0018 | 0.010 | tr. | tr. | Invention Example |
| 5 | 0.0025 | 6.5 | 0.05 | 0.001 | 0.0024 | 0.0017 | 0.0001 | 0.0021 | 0.010 | tr. | tr. | Invention Example |
| 7 | 0.0030 | 7.5 | 0.05 | 0.001 | 0.0024 | 0.0017 | 0.0001 | 0.0021 | 0.010 | tr. | tr. | Comparative Example |
| 8 | 0.0030 | 2.0 | 0.05 | 0.30 | 0.0018 | 0.0026 | 0.0001 | 0.0014 | 0.008 | tr. | tr. | Invention Example |
| 9 | 0.0030 | 2.2 | 0.05 | 1.0 | 0.0018 | 0.0026 | 0.0001 | 0.0014 | 0.012 | tr. | tr. | Invention Example |
| 10 | 0.0025 | 2.0 | 0.50 | 1.5 | 0.0015 | 0.0021 | 0.0001 | 0.0020 | 0.010 | tr. | tr. | Invention Example |
| 11 | 0.0025 | 2.0 | 0.50 | 2.5 | 0.0015 | 0.0021 | 0.0001 | 0.0020 | 0.010 | tr. | tr. | Invention Example |
| 12 | 0.0025 | 2.0 | 0.50 | 4.0 | 0.0015 | 0.0021 | 0.0001 | 0.0020 | 0.010 | tr. | tr. | Comparative Example |
| 13 | 0.0030 | 3.0 | 0.05 | 0.001 | 0.0024 | 0.0027 | 0.0001 | 0.0015 | 0.010 | tr. | tr. | Invention Example |
| 14 | 0.0030 | 3.0 | 1.0 | 0.001 | 0.0024 | 0.0027 | 0.0001 | 0.0015 | 0.010 | tr. | tr. | Invention Example |
| 15 | 0.0030 | 2.5 | 1.5 | 0.001 | 0.0024 | 0.0027 | 0.0002 | 0.0018 | 0.010 | tr. | tr. | Invention Example |
| 16 | 0.0030 | 2.5 | 2.5 | 0.001 | 0.0024 | 0.0027 | 0.0003 | 0.0018 | 0.010 | tr. | tr. | Invention Example |
| 17 | 0.0030 | 2.2 | 4.0 | 0.001 | 0.0024 | 0.0027 | 0.0004 | 0.0024 | 0.010 | tr. | tr. | Comparative Example |
| 18 | 0.0040 | 3.0 | 0.50 | 0.50 | 0.0018 | 0.0026 | 0.0001 | 0.0007 | 0.010 | tr. | tr. | Invention Example |
| 19 | 0.010 | 3.0 | 0.50 | 0.001 | 0.0020 | 0.0021 | 0.0001 | 0.0010 | 0.010 | tr. | tr. | Comparative Example |
| 20 | 0.0025 | 3.3 | 0.50 | 0.003 | 0.0018 | 0.0026 | 0.0001 | 0.0015 | 0.005 | tr. | tr. | Invention Example |
| 21 | 0.0025 | 3.3 | 0.50 | 0.003 | 0.0018 | 0.0026 | 0.0005 | 0.0015 | 0.050 | tr. | tr. | Invention Example |
| 22 | 0.0025 | 3.3 | 0.50 | 0.003 | 0.0018 | 0.0026 | 0.0001 | 0.0015 | 0.12 | tr. | tr. | Invention Example |
| 23 | 0.0025 | 3.3 | 0.50 | 0.003 | 0.0018 | 0.0026 | 0.0001 | 0.0015 | 0.30 | tr. | tr. | Comparative Example |
| 24 | 0 0025 | 3.0 | 0.50 | 0.50 | 0.010 | 0.0026 | 0.0001 | 0.0015 | 0.01 | tr. | tr. | Comparative Example |
| 25 | 0.0025 | 3.0 | 0.50 | 0.50 | 0.003 | 0.012 | 0.0001 | 0.0018 | 0.01 | tr. | tr. | Comparative Example |
| 26 | 0.0030 | 3.0 | 0.50 | 0.001 | 0.0018 | 0.0026 | 0.0001 | 0.0015 | 0.015 | 0.005 | tr. | Invention Example |
| 27 | 0.0030 | 3.0 | 0.50 | 0.001 | 0.0018 | 0.0026 | 0.0001 | 0.0015 | 0.015 | 0.050 | tr. | Invention Example |
| 28 | 0.0030 | 3.0 | 0.50 | 0.001 | 0.0018 | 0.0026 | 0.0001 | 0.0015 | 0.015 | 0.10 | tr. | Invention Example |
| 29 | 0.0030 | 3.0 | 0.50 | 0.001 | 0.0018 | 0.0026 | 0.0001 | 0.0015 | 0.015 | 0.30 | tr. | Invention Example |
| 30 | 0.0030 | 3.0 | 0.50 | 0.001 | 0.0018 | 0.0026 | 0.0001 | 0.0015 | 0.015 | 0.80 | tr. | Comparative Example |
| 31 | 0.0030 | 3.0 | 0.50 | 0.50 | 0.0018 | 0.0029 | 0.0001 | 0.0015 | 0.010 | tr. | 0.80 | Comparative Example |
| 32 | 0.0030 | 3.0 | 0.50 | 0.001 | 0.0018 | 0.0026 | 0.0001 | 0.0015 | 0.015 | 0.040 | 0.040 | Invention Example |
| 33 | 0.0020 | 2.5 | 0.05 | 0.001 | 0.0020 | 0.0025 | 0.0001 | 0.0025 | 0.010 | 0.050 | tr. | Invention Example |
| 34 | 0.0035 | 3.0 | 0.50 | 0.50 | 0.0018 | 0.0026 | 0.0001 | 0.0007 | 0.010 | tr. | tr. | Invention Example |
| 35 | 0.0035 | 3.0 | 0.50 | 0.50 | 0.0018 | 0.0026 | 0.0001 | 0.0007 | 0.010 | tr. | tr. | Comparative Example |
| 36 | 0.0035 | 2.5 | 0.50 | 0.50 | 0.0018 | 0.0026 | 0.0001 | 0.0007 | 0.010 | tr. | tr. | Comparative Example |
| 37 | 0.0035 | 3.0 | 1.50 | 0.60 | 0.0022 | 0.0026 | 0.0001 | 0.0010 | 0.010 | tr. | tr. | Invention Example |
| 38 | 0.0030 | 3.0 | 0.50 | 0.50 | 0.0018 | 0.0026 | 0.0010 | 0.0010 | 0.010 | tr. | tr. | Comparative Example |
| 39 | 0.0030 | 3 0 | 0.50 | 0.50 | 0.0018 | 0.0026 | 0.0001 | 0.010 | 0.010 | tr. | tr. | Comparative Example |
| 40 | 0.0025 | 1.5 | 0.50 | 0.30 | 0.0020 | 0.0024 | 0.00003 | 0.0010 | 0.010 | tr. | tr. | Comparative Example |
| 41 | 0.0025 | 1.5 | 0.50 | 0.30 | 0.0019 | 0.0023 | 0.0001 | 0.0003 | 0.010 | tr. | tr. | Comparative Example |
| 42 | 0.0025 | 1.5 | 0.50 | 0.30 | 0.0024 | 0.0026 | 0.00004 | 0.0002 | 0.010 | tr. | tr. | Comparative Example |

TABLE 2

| No. | Production conditions | | Crystal grain | Punchability | | Iron Loss $W_{15/50}$ | | | Remarks |
|---|---|---|---|---|---|---|---|---|---|
| | Thickness t (mm) | Finish annealing temperature (° C.) | size of product sheet (μm) | Amount of shear drop in punching x (mm) | Amount of shear drop x/thickness t | Iron loss at 30 mm width | Iron loss loss at 10 mm width | Iron loss deterioration rate (%) | |
| 1 | 0.35 | 940 | 60 | 0.015 | 0.043 | 2.20 | 2.50 | 13.6 | Invention Example |
| 2 | 0.35 | 950 | 70 | 0.060 | 0.171 | 2.80 | 3.60 | 28.6 | Comparative Example |
| 3 | 0.30 | 950 | 70 | 0.015 | 0.050 | 2.50 | 2.90 | 16.0 | Invention Example |
| 4 | 0.25 | 930 | 55 | 0.015 | 0.060 | 2.00 | 2.27 | 13.5 | Invention Example |
| 5 | 0.50 | 950 | 70 | 0.025 | 0.050 | 2.20 | 2.41 | 9.5 | Invention Example |
| 6 | 0.15 | 950 | 70 | 0.010 | 0.067 | 1.80 | 1.95 | 8.3 | Invention Example |
| 7 | It is impossible to obtain a product because breakage is caused during the cold rolling | | | — | — | — | — | — | Comparative Example |
| 8 | 0.35 | 960 | 80 | 0.018 | 0.051 | 2.50 | 2.95 | 18.0 | Invention Example |
| 9 | 0.35 | 960 | 80 | 0.020 | 0.057 | 2.40 | 2.80 | 16.7 | Invention Example |
| 10 | 0.35 | 980 | 100 | 0.016 | 0.046 | 2.30 | 2.64 | 14.8 | Invention Example |
| 11 | 0.35 | 950 | 75 | 0.015 | 0.043 | 2.10 | 2.35 | 11.9 | Invention Example |

TABLE 2-continued

| No. | Production conditions: Thickness t (mm) | Production conditions: Finish annealing temperature (° C.) | Crystal grain size of product sheet (μm) | Punchability: Amount of shear drop in punching x (mm) | Punchability: Amount of shear drop x/thickness t | Iron Loss $W_{15/50}$: Iron loss at 30 mm width | Iron Loss $W_{15/50}$: Iron loss loss at 10 mm width | Iron Loss $W_{15/50}$: Iron loss deterioration rate (%) | Remarks |
|---|---|---|---|---|---|---|---|---|---|
| 12 | It is impossible to obtain a product because breakage is caused during the cold rolling | | | — | — | — | — | — | Comparative Example |
| 13 | 0.30 | 950 | 70 | 0.016 | 0.053 | 2.40 | 2.80 | 16.7 | Invention Example |
| 14 | 0.25 | 910 | 40 | 0.014 | 0.056 | 2.20 | 2.55 | 15.9 | Invention Example |
| 15 | 0.25 | 930 | 50 | 0.014 | 0.056 | 2.10 | 2.40 | 14.3 | Invention Example |
| 16 | 0.20 | 950 | 70 | 0.012 | 0.060 | 2.05 | 2.30 | 12.2 | Invention Example |
| 17 | 0.50 | 980 | 100 | 0.080 | 0.160 | 2.80 | 3.80 | 35.7 | Comparative Example |
| 18 | 0.35 | 950 | 70 | 0.016 | 0.046 | 2.20 | 2.55 | 15.9 | Invention Example |
| 19 | 0.35 | 950 | 70 | 0.017 | 0.049 | 3.80 | 4.50 | 18.4 | Comparative Example |
| 20 | 0.35 | 980 | 100 | 0.025 | 0.071 | 2.30 | 2.75 | 19.6 | Invention Example |
| 21 | 0.35 | 960 | 85 | 0.022 | 0.063 | 2.20 | 2.60 | 18.2 | Invention Example |
| 22 | 0.35 | 950 | 70 | 0.020 | 0.057 | 2.15 | 2.45 | 14.0 | Invention Example |
| 23 | It is impossible to obtain a product because breakage is caused during the cold rolling | | | — | — | — | — | — | Comparative Example |
| 24 | 0.50 | 930 | 50 | 0.050 | 0.100 | 3.81 | 4.40 | 15.5 | Comparative Example |
| 25 | 0.50 | 930 | 50 | 0.050 | 0.100 | 3.85 | 4.40 | 14.3 | Comparative Example |
| 26 | 0.35 | 970 | 90 | 0.020 | 0.057 | 2.15 | 2.45 | 14.0 | Invention Example |
| 27 | 0.35 | 990 | 105 | 0.022 | 0.063 | 2.13 | 2.42 | 13.6 | Invention Example |
| 28 | 0.35 | 1020 | 120 | 0.025 | 0.071 | 2.12 | 2.41 | 13.7 | Invention Example |
| 29 | 0.35 | 1020 | 120 | 0.030 | 0.086 | 2.12 | 2.41 | 13.7 | Invention Example |
| 30 | 0.35 | 1000 | 100 | 0.025 | 0.071 | 3.80 | 4.52 | 18.9 | Comparative Example |
| 31 | 0.35 | 1000 | 100 | 0.025 | 0.071 | 3.90 | 4.59 | 17.7 | Comparative Example |
| 32 | 0.35 | 960 | 85 | 0.022 | 0.063 | 2.15 | 2.42 | 12.6 | Invention Example |
| 33 | 0.35 | 970 | 90 | 0.016 | 0.046 | 2.10 | 2.35 | 11.9 | Invention Example |
| 34 | 0.25 | 1000 | 110 | 0.013 | 0.052 | 2.00 | 2.25 | 12.5 | Invention Example |
| 35 | 0.50 | 750 | 20 | 0.025 | 0.050 | 3.70 | 4.05 | 9.5 | Comparative Example |
| 36 | 0.50 | 1100 | 200 | 0.045 | 0.090 | 2.90 | 3.75 | 29.3 | Comparative Example |
| 37 | 0.25 | 960 | 80 | 0.020 | 0.080 | 1.90 | 2.15 | 13.2 | Invention Example |
| 38 | 0.50 | 950 | 70 | 0.020 | 0.040 | 3.80 | 4.20 | 10.5 | Comparative Example |
| 39 | 0.50 | 940 | 60 | 0.020 | 0.040 | 3.85 | 4.25 | 10.4 | Comparative Example |
| 40 | 0.35 | 950 | 72 | 0.060 | 0.171 | 2.95 | 3.70 | 25.4 | Comparative Example |
| 41 | 0 35 | 960 | 82 | 0.065 | 0.186 | 2.85 | 3.75 | 31.6 | Comparative Example |
| 42 | 0.35 | 970 | 90 | 0.068 | 0.194 | 2.80 | 3.80 | 35.7 | Comparative Example |

A sample with a length of 180 mm and a width of 30 mm and a sample with a length of 180 mm and a width of 10 mm are take out from the thus obtained product sheet in L-direction and C-direction by punching set to a clearance of 5%, and then iron loss $W_{15/50}$ thereof is measured by Epstein test to determine an iron loss deterioration ratio. With respect to the sample with a length of 180 mm and a width of 10 mm, the measurement is conducted by arranging three samples with a width of 10 mm so as to provide a width of 30 mm as shown in FIG. 2. With respect to the product sheet, the amount of shear drop of the edge face after the punching is measured, and the average crystal grain size at a section in the rolling direction (L-direction) is measured by linear intercept method.

The measured results are also shown in Table 2. As seen from Table 2, the non-oriented electrical steel sheets satisfying the conditions of the invention are excellent not only in the iron loss property before punching but also in the iron loss property after punching and can suppress the deterioration of the iron loss property by punching.

The invention claimed is:

1. A non-oriented electrical steel sheet having chemical composition comprising C: not more than 0.005 mass %, Si: 2~7 mass %, Mn: 0.03~3 mass %, Al: not more than 3 mass %, P: not more than 0.2 mass %, S: not more than 0.005 mass %, N: not more than 0.005 mass %, Se: 0.0001~0.0005 mass %, As: 0.0005~0.005 mass % and the remainder being Fe and inevitable impurities, and an iron loss $W_{15/50}$ in excitation at 50 Hz and 1.5 T of not more than 3.5 W/kg, a ratio (x/t) of amount of shear drop x (mm) to thickness t (mm) in punching of steel sheet of not more than 0.15, and an average crystal grain size of 30~150 μm.

2. The non-oriented electrical steel sheet according to claim 1 containing either one or both of Sn: 0.003~0.5 mass % and Sb: 0.003~0.5 mass % in addition to the chemical composition.

* * * * *